US008577276B2

(12) United States Patent
Kim et al.

(10) Patent No.: US 8,577,276 B2
(45) Date of Patent: Nov. 5, 2013

(54) STRUCTURE TO GUIDE PRINT MEDIUM AND IMAGE FORMING APPARATUS EMPLOYING THE SAME

(75) Inventors: Jeong-hwan Kim, Gunsan-si (KR); Myung-ho Kyung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 551 days.

(21) Appl. No.: 12/365,210

(22) Filed: Feb. 4, 2009

(65) Prior Publication Data

US 2009/0297241 A1 Dec. 3, 2009

(30) Foreign Application Priority Data

Jun. 3, 2008 (KR) ..... 2008-0052321

(51) Int. Cl.
*G03G 15/00* (2006.01)
*G03G 15/08* (2006.01)
*G03G 15/16* (2006.01)

(52) U.S. Cl.
USPC ..... 399/388; 399/121; 399/316

(58) Field of Classification Search
USPC ..... 399/388, 316, 308, 302, 121, 317
See application file for complete search history.

(56) References Cited

U.S. PATENT DOCUMENTS

| | | | | |
|---|---|---|---|---|
| 6,813,471 | B2 * | 11/2004 | Sawai et al. | 399/388 |
| 8,019,264 | B2 * | 9/2011 | Murayama | 399/316 |
| 2007/0201912 | A1 * | 8/2007 | Montfort et al. | 399/316 |
| 2008/0003022 | A1 * | 1/2008 | Sakashita et al. | 399/303 |

FOREIGN PATENT DOCUMENTS

| | | | |
|---|---|---|---|
| JP | 06003974 | A * | 1/1994 |
| JP | 2004012851 | | 1/2004 |
| JP | 2005298181 | | 10/2005 |

OTHER PUBLICATIONS

Korean Office Action issued Apr. 16, 2011 in KR Application No. 10-2008-0052321.

* cited by examiner

*Primary Examiner* — Matthew G Marini
*Assistant Examiner* — Justin Olamit
(74) *Attorney, Agent, or Firm* — Stanzione & Kim, LLP

(57) ABSTRACT

A structure to guide a take-in direction of a print medium to be taken in a carrying part where the print medium is carried, the structure includes: a guide unit which changes a travel direction of the print medium from a feeding direction, in which the print medium is supplied from a medium feeding unit, to the take-in direction of the print medium; and a vibration damper which prevents a bottom part of the print medium from shaking and vibrating when the print medium is free from the guide unit.

21 Claims, 13 Drawing Sheets

STRUCTURE TO GUIDE PRINT MEDIUM AND IMAGE FORMING APPARATUS EMPLOYING THE SAME

CROSS-REFERENCE TO RELATED APPLICATIONS

This application claims priority from Korean Patent Application No. 10-2008-0052321, filed on Jun. 3, 2008 in the Korean Intellectual Property Office, the disclosure of which is incorporated herein by reference in its entirety.

BACKGROUND OF THE INVENTION

1. Field of the Invention

The present general inventive concept relates to a structure to guide a print medium supplied from a medium feeding unit and an image forming apparatus employing the same, and more particularly to a structure to guide a print medium and an image forming apparatus employing the same, which can reduce a defect in picture quality of an image transferred to a bottom part of the print medium.

2. Description of the Related Art

In general, an electrophotographic image forming apparatus forms an image through electric charge, exposure, development or the like processes. A transfer unit directly or indirectly transfers an image from a photosensitive medium to a print medium.

For example, the indirect-type transfer unit includes a transfer belt to primarily receive a visible image formed on the photosensitive medium, and a transfer roller to transfer the image from the transfer belt to the print medium supplied through a medium feeding path. In an image forming apparatus using the indirect-type transfer unit, the print medium is taken into a transfer nip in a direction different from a taken-in direction of an image formed on the transfer belt since a layout space where elements are arranged is limited, or for other similar reasons.

Here, because the taken-in direction of the print medium affects picture quality, the taken-in direction of the print medium to the transfer nip is changed from that of when the print medium is supplied from a medium feeding unit, thereby making the taken-in angle of the print medium within a predetermined range.

However, when a bottom part of the print medium is free from a guide member for guiding the taken-in direction of the print medium, the bottom part of the print medium is vibrated or shaken due to change the direction of the print medium. Thus, an image transferred to the bottom part of the print medium may be dislocated or blurred.

SUMMARY OF THE INVENTION

The present general inventive concept can provide a structure to guide a print medium and an image forming apparatus employing the same, which can reduce a defect in picture quality of an image due to a shake given in a bottom part of the print medium and prevent the print medium from being jammed, with a minimum change in a layout of components for affecting a taken-in direction of the print medium.

Additional aspects and utilities of the present general inventive concept will be set forth in part in the description which follows and, in part, will be obvious from the description, or may be learned by practice of the general inventive concept.

Embodiments of the present general inventive concept can be achieved by providing a structure to guide a take-in direction of a print medium to be taken in a carrying part where the print medium is carried, the structure including: a guide unit which changes a travel direction of the print medium from a feeding direction, in which the print medium is supplied from a medium feeding unit, to the take-in direction of the print medium; and a vibration damper which relieves a bottom part of the print medium from shaking and vibrating when the print medium is free from the guide unit.

The guide unit may be arranged on a medium feeding path from the medium feeding unit, and includes a guide plate changing the travel direction of the print medium into the take-in direction.

The guide unit may further include a guide film to keep the travel direction of the print medium changed by the guide plate in the take-in direction.

The vibration damper may be formed integrally with or coupled to an end part of the guide plate, and includes a regulation plate with a regulation surface bent at least once with respect to a guide surface of the guide plate.

The vibration damper may be coupled to an end part of the guide plate, and includes a regulation member with a regulation surface disposed on a different plane from a guide surface of the guide plate.

The regulation member and the guide plate may be different in material from each other.

The guide unit may include a guide block having a predetermined thickness and a guide surface with which the print medium is in contact, and the vibration damper may include a regulation surface forming a predetermined gradient at an end part of the guide block.

The vibration damper may include a regulation plate spaced apart from the guide unit at a certain position not to obstruct travel of the print medium in the travel direction, and contacting a bottom part of the print medium when the print medium is free from the guide unit.

The regulation plate may be movably installed at the certain position, and the vibration damper includes a driving unit to drive the regulation plate.

Embodiments of the present general inventive concept can also be achieved by providing an image forming apparatus including: a medium feeding unit which supplies a print medium; an image forming unit which forms an image; a transfer unit which transfers the image from the image forming unit to the print medium; a fusing unit which fuses the image transferred to the print medium; a medium take-out unit which takes out the print medium; and a structure for guiding a take-in direction of a print medium to be taken in a carrying part where the print medium is carried, the structure including: a guide unit which changes a travel direction of the print medium from a feeding direction, in which the print medium is supplied from a medium feeding unit, to the take-in direction of the print medium, and a vibration damper which relieves a bottom part of the print medium from shaking and vibrating when the print medium is free from the guide unit.

The structure to guide the print medium may be provided in at least one of carrying paths around the medium feeding unit, the transfer unit, the fusing unit and the medium take-out unit.

The transfer unit may include: a driving roller; a transfer belt to be rotated by the driving roller; and a transfer roller opposite to the driving roller with the transfer belt interposed therebetween and forming a transfer nip.

The guide unit may be arranged on a medium feeding path from the medium feeding unit, and includes a guide plate changing the travel direction of the print medium into the take-in direction.

The guide unit may further include a guide film to keep the travel direction of the print medium changed by the guide plate in the take-in direction.

The vibration damper may be formed integrally with or coupled to an end part of the guide plate, and includes a regulation plate with a regulation surface bent at least once with respect to a guide surface of the guide plate.

The vibration damper may be coupled to the end part of the guide plate, and includes a regulation member with a regulation surface disposed on a different plane from a guide surface of the guide plate.

The guide unit may include a guide block having a predetermined thickness and a guide surface with which the print medium is in contact, and the vibration damper may include a regulation surface forming a predetermined gradient at an end part of the guide block.

The vibration damper may include a regulation plate spaced apart from the guide unit at a certain position not to obstruct travel of the print medium in the travel direction, and contacting a bottom part of the print medium when the print medium is free from the guide unit.

The regulation plate may be movably installed at the certain position, and the vibration damper may include a driving unit to drive the regulation plate.

Embodiments of the present general inventive concept can also be achieved by providing a guide unit to guide a printing medium from a first traveling direction to a take-in direction within an image forming apparatus, the guide unit including a guide member including a guide surface to guide the printing medium along the take-in direction once the printing medium reaches the guide member while traveling along the first direction, and a vibration damper to prevent the printing medium from vibrating when a trailing end of the printing medium extends past the guide member while continuing to travel in the take-in direction.

The vibration damper may be disposed at a position downstream of the guide surface such that the trailing end of the printing medium contacts the vibration damper immediately after moving past the guide member.

The vibration damper can extend from and at an angle with respect to the guide. Surface.

The vibration damper can extend from the guide surface and includes two bent portions to guide the trailing end of the printing medium.

The guide member and the vibration damper can be formed as one unit such that the vibration damper extends from an end thereof at an angle with respect to the guide surface.

The vibration damper can extend along a side of the guide member opposite to a side in which the printing medium extends and to a longer length than the guide member such that the trailing end of the printing medium swings into contact with the vibration member after moving past the guide surface.

The vibration damper includes a plate which is separate from the guide member and includes a driving unit to move the vibration member to different angles with respect to the guide surface.

BRIEF DESCRIPTION OF THE DRAWINGS

The above and/or other aspects and utilities of the present general inventive concept will become apparent and more readily appreciated from the following description of the exemplary embodiments, taken in conjunction with the accompanying drawings, in which.

DETAILED DESCRIPTION OF THE PREFERRED EMBODIMENTS

Figure 1:
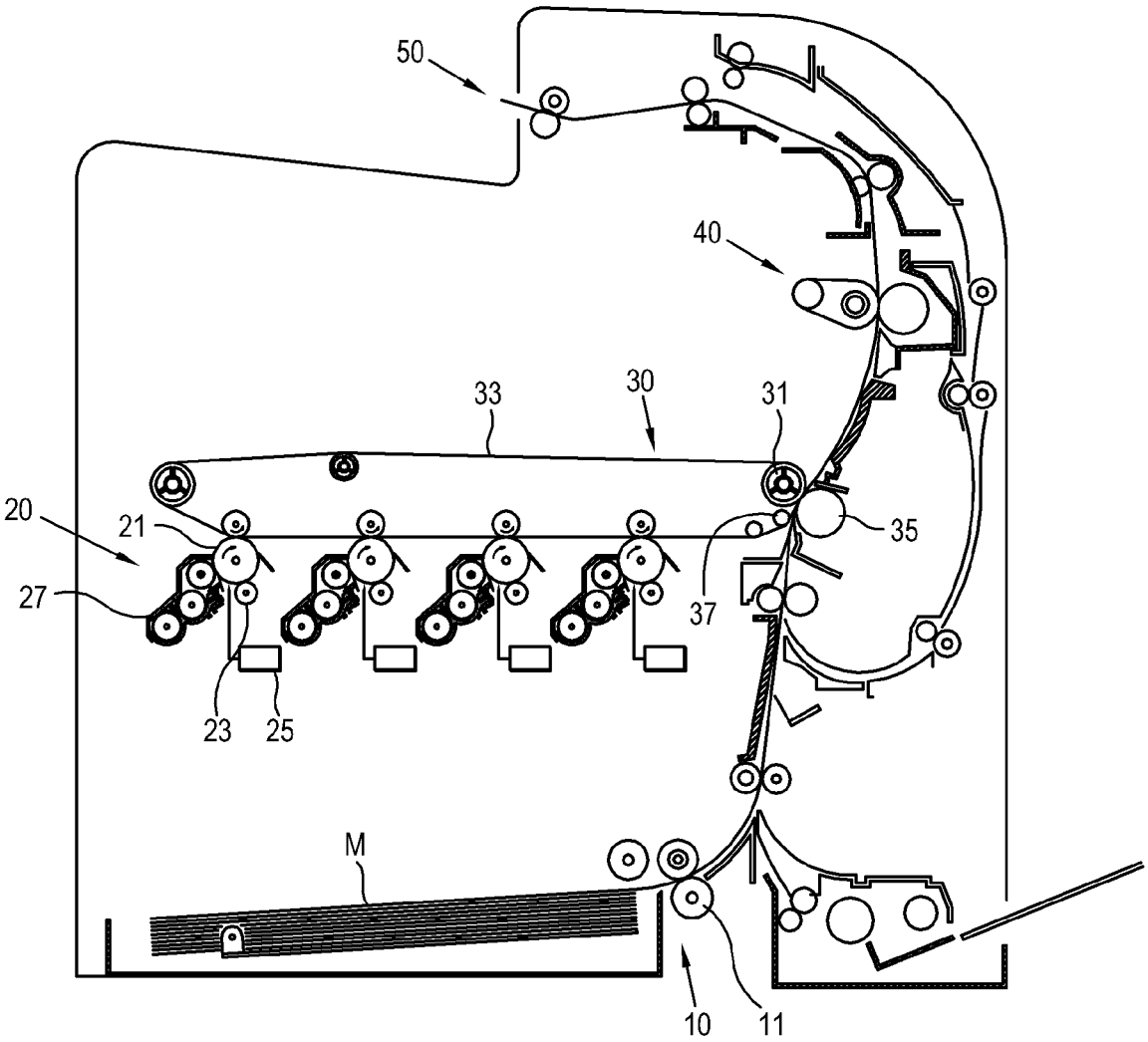
FIG. 1 is a schematic view of an electrophotographic image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a schematic view of an electrophotographic image forming apparatus according to an embodiment of the present general inventive concept. Referring to FIG. 1, an image forming apparatus according to this embodiment includes a medium feeding unit 10 to supply a print medium M; an image forming unit 20 to form an image; a transfer unit 30 to transfer an image to the print medium M; a fusing unit 40 to fuse a toner image transferred to the print medium M; and a medium take-out unit 50 to take out the print medium M.

The image forming unit 20 includes a photosensitive medium 21; an electric-charger 23 to charge the print medium 21 with a predetermined electric potential; an exposure unit 25 to form a latent image on the print medium 21; and a developing unit 27 to develop a visible image from the latent image formed on the print medium 21. As shown in FIG. 1, the image forming unit 20 is individually provided according to colors, and thus they form a full-colored image through single development process. However, the image forming unit 20 is not limited to the foregoing configuration, and may have a configuration for a mono image or multi-path color image.

The transfer unit 30 includes a driving roller 31, a transfer belt 33 to be rotated by the driving roller 31, and a transfer roller 35 opposite to the driving roller 31 with the transfer belt 33 interposed therebetween.

Thus, the visible images formed on the plurality of photosensitive mediums 21 are primarily transferred to the transfer belt 33, and then transferred from the transfer belt 33 to the print medium M being taken to a transfer nip N (FIG. 2) formed between the transfer belt 33 and the transfer roller 35.

Here, a predetermined bias voltage is applied to the transfer roller 35, and therefore the print medium M being taken into the transfer nip N is partially charged with electricity. Accordingly, the image formed on the transfer belt 33 is transferred to the print medium M by an electrostatic attractive force.

Figure 2:
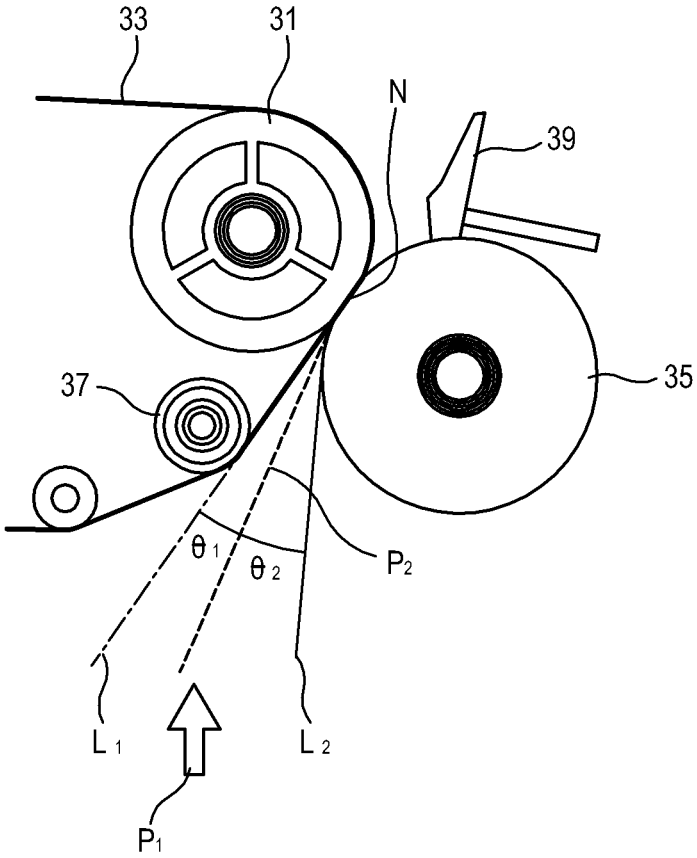
FIG. 2 illustrates a relationship between a taken-in direction of a print medium and a taken-in direction of an image formed on a transfer belt.

Meanwhile, the image forming unit 20 and the medium feeding unit 10 are arranged in different places, so that a take-in direction $P_2$ of the print medium M toward the transfer nip N is different from a take-in direction $L_1$ of the image formed in the transfer belt 33 (refer to FIG. 2). At this time, the take-in direction of the print medium M has to be set up to satisfy $\theta_1<\theta_2$ since it affects the picture quality. Here, $\theta_1$ is an angle between the take-in direction $L_1$ of the image and the take-in direction $P_2$ of the print medium M, and $\theta_2$ is an angle between a tangential line $L_2$ contacting the transfer roller 35 at a start position of the transfer nip N and the take-in direction $P_2$ of the print medium.

If the take-in direction $P_2$ is set up not to satisfy the condition of $\theta_1<\theta_2$, a steep electric-field for the transfer may be formed in the print medium M to be taken in the transfer nip N, thereby deteriorating the picture quality. Further, the take-in direction $P_2$ not satisfying the condition of $\theta_1<\theta_2$ may affect operations of a static eraser 39 that eliminates static from the rear side of the print medium M after the transfer, so that a printed image can have a defective pattern such as, for example, a bird's foot, thereby deteriorating the picture quality.

Figure 3A:
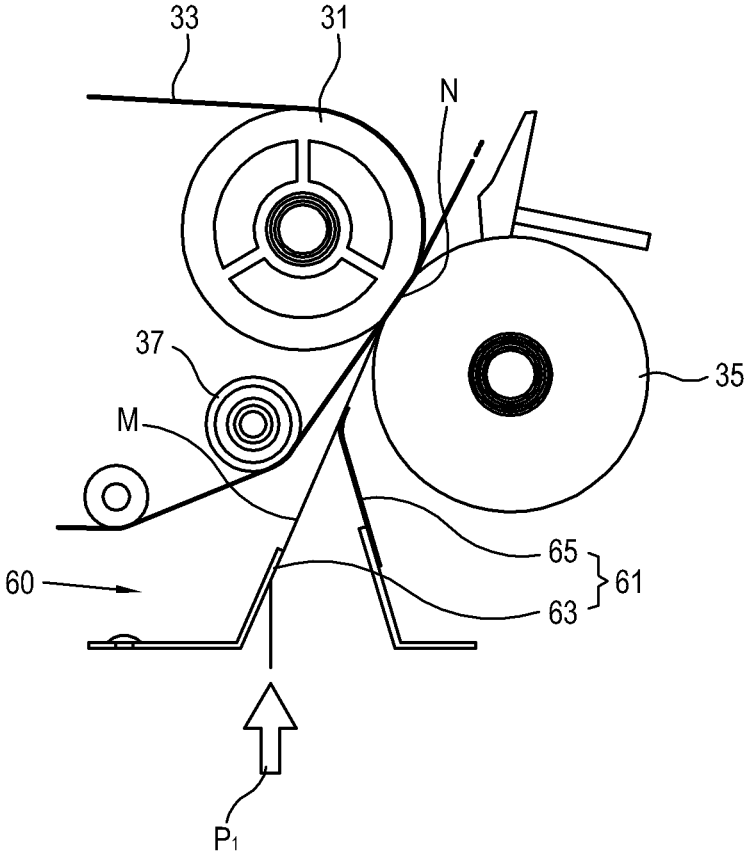
FIGS. 3A and 3B illustrate a structure to guide the print medium in the image forming apparatus according to an embodiment of the present general inventive concept.
Figure 3B:
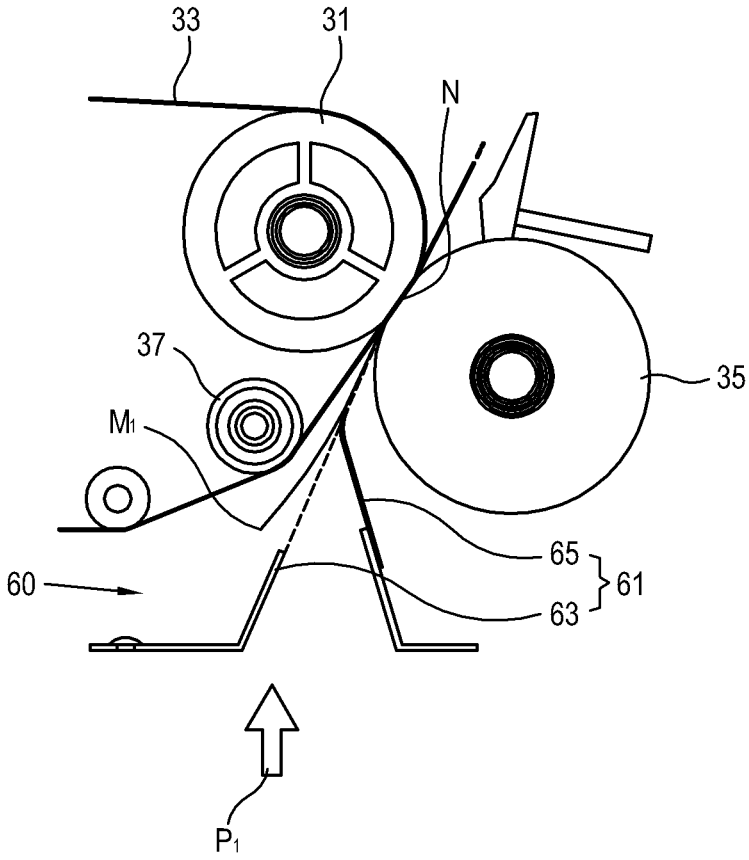

To make the take-in direction $P_2$ satisfy the condition of $\theta_1<\theta_2$, the image forming apparatus according to an embodiment of the present general inventive concept employs a print-medium guiding structure 60 as shown in FIGS. 3A and 3B. Further, the transfer unit 30 may further include a guide roller 37 to adjust a gradient of the transfer belt 33 in the vicinity of the transfer nip N, so that the take-in direction $P_2$ of the image can be angled toward a feeding direction $P_1$ of the print medium M in order to more easily satisfy the foregoing condition.

Referring to FIG. 3A, the print-medium guiding structure 60 according to an embodiment of the present general inventive concept includes a guide unit 61 to make the print medium M be supplied from the medium feeding unit 10 in the take-in direction.

The guide unit 61 changes the travel direction of the print medium M from the feeding direction $P_1$ where the print medium M is supplied from the medium feeding unit 10 to the take-in direction $P_2$ of the print medium M. To this end, the guide unit 61 includes a guide plate 63 to change the travel direction of the print medium M into the take-in direction, and a guide film 65 to make the print medium M changed in the travel direction by the guide plate 63 remain in the take-in direction.

The guide plate 63 is arranged on a medium feeding path and has one end placed at a transfer position, i.e., separated from the transfer nip N, which includes a guide surface 63*a* inclined with regard to the medium feeding path. The guide surface 63*a* primarily changes the travel direction of the supplied print medium M into the take-in direction. The guide film 65 has one end placed between the guide plate 63 and the transfer nip N, and contacts a rear portion (or trailing end) of a print surface of the print medium M. The guide film 65 guides the print medium M to move toward the transfer nip N while remaining in the take-in direction changed by the guide plate 63.

In this case, such a direction change of the print medium M causes a bottom part $M_1$ of the print medium M to vibrate or shake when the print medium M, being taken in the transfer nip N, becomes free from the guide plate 63, as shown in FIG. 3B. The vibration is conveyed to the transfer nip N, and the rapid vibration based on the shaking of the print medium M causes the transfer electric field of the transfer nip N to be unstable. Thus, an image transferred to the bottom part $M_1$ of the print medium may be dislocated or blurred.

To solve this problem, it may be considered to just extend the end of the guide plate 63, but in this case the guide plate 63 has to be rearranged because the extension of the guide plate 63 affects the take-in direction of the print medium M. Further, when the guide plate 63 is rearranged toward the transfer belt 33, an extended part of the guide plate 63 may scratch the surface of the transfer belt 33 since it occupies a relatively large part of a limited space. Also, other adverse effects may be expected, and thus it is difficult to apply this case.

Alternatively, it may be considered that not only the end of the guide plate 63 is extended but also the gradient of the guide surface 63*a* is changed. In this case, the take-in angle of the print medium M is changed so that the foregoing condition of $\theta_1<\theta_2$ can not be satisfied. At this time, the picture quality may be deteriorated since the steep electric-field for the transfer is formed in the print medium M at the transfer nip N and the static is poorly erased in printing on both sides of the print medium M. Thus, it is difficult to apply this case.

Considering the above described case, the print-medium guiding structure 60 according to an embodiment of the present general inventive concept includes a vibration damper 70 in addition to the guide unit 61. The vibration damper 70 relieves the bottom part of the print medium M from shaking and vibrating when the print medium M is free from the guide unit 61.

Figure 4:
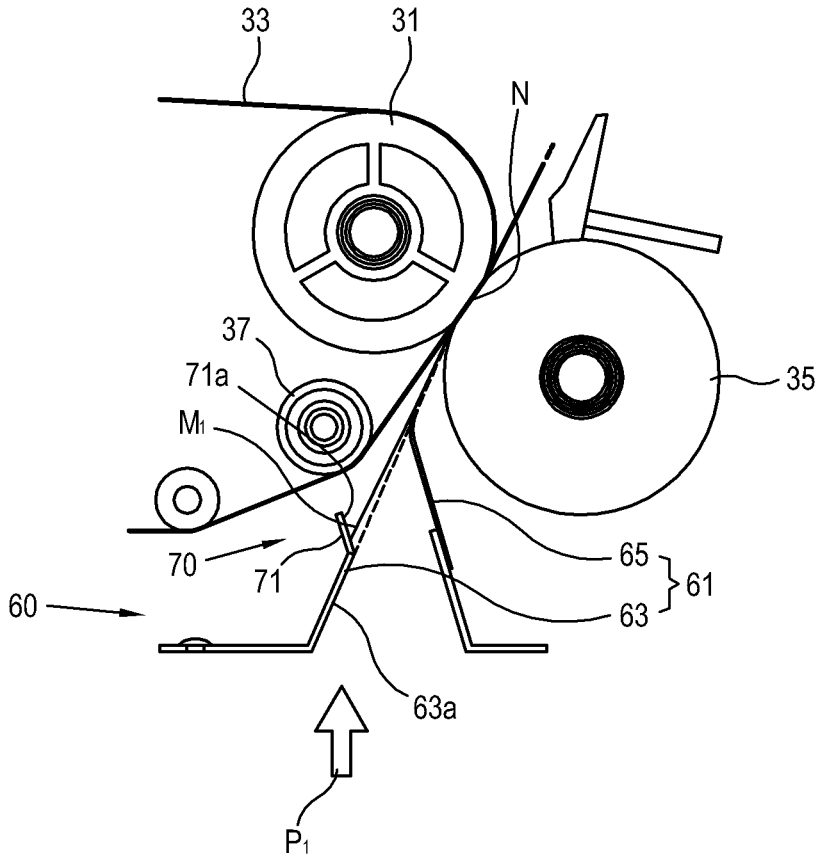
FIGS. 4 and 5 are schematic views of a structure to guide the print medium according to an embodiment of the present general inventive concept.
Figure 5:
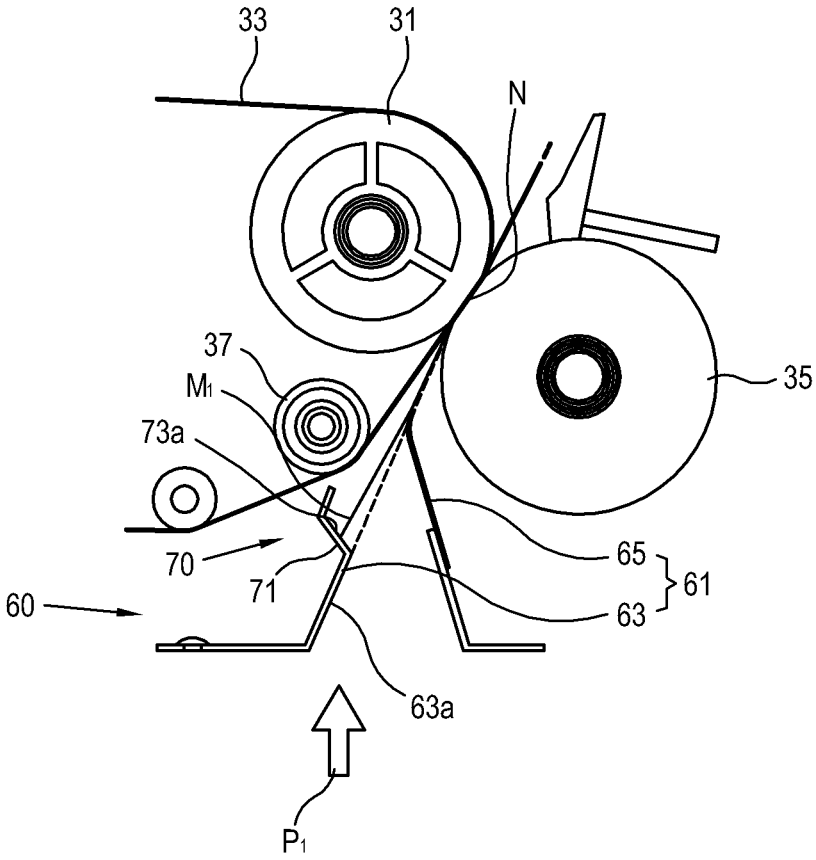

Referring to FIGS. 4 and 5, the vibration damper 70 of the print-medium guiding structure 60 according to embodiments of the present general inventive concept includes a regulation plate 71 formed integrally with or coupled to an end part of the guide plate 63. The regulation plate 71 can have a regulation surface 71*a* which is bent once, as illustrated in FIG. 4, or can have a regulation surface 73*a* which can be bent twice or more times with regard to the guide surface 63*a* of the guide plate 63, as illustrated in FIG. 5.

FIG. 4 shows that the regulation plate 71 is formed integrally with the end part of the guide plate 63 and has the regulation surface 71*a* bent once with respect to the guide surface 63*a* of the guide plate 63. Further, FIG. 5 shows that the regulation plate 71 has the regulation surface 73*a* bent twice with respect to the guide surface 63*a*.

Thus, the regulation plate 71 prevents the bottom part $M_1$ of the print medium M from shaking and vibrating due to the hardness of the print medium M, since the bottom part $M_1$ contacts the regulation surface 71*a*, 73*a* at the time when the bottom part $M_1$ of the print medium M becomes free from the end part of the guide surface 63*a*. Meanwhile, when the bottom part $M_1$ of the print medium M is placed on the guide surface 63*a*, the regulation plate 71 does not affect the movement of the print medium M so that the take-in direction formed by the guide plate 63 can be kept constant.

FIGS. 4 and 5 show that the regulation plate 71 and the guide plate 63 can be formed as a single body by way of example, but is not limited thereto. Alternatively, the regulation plate 71 may be separately provided and coupled to the guide plate 63. In this case, the regulation plate 71 and the guide plate 63 may be different in material from each other. Accordingly, a material that has no effect on the transfer electric field at the transfer nip N may be selected for the regulation plate 71 regardless of the material of the guide plate 63.

Figure 6:
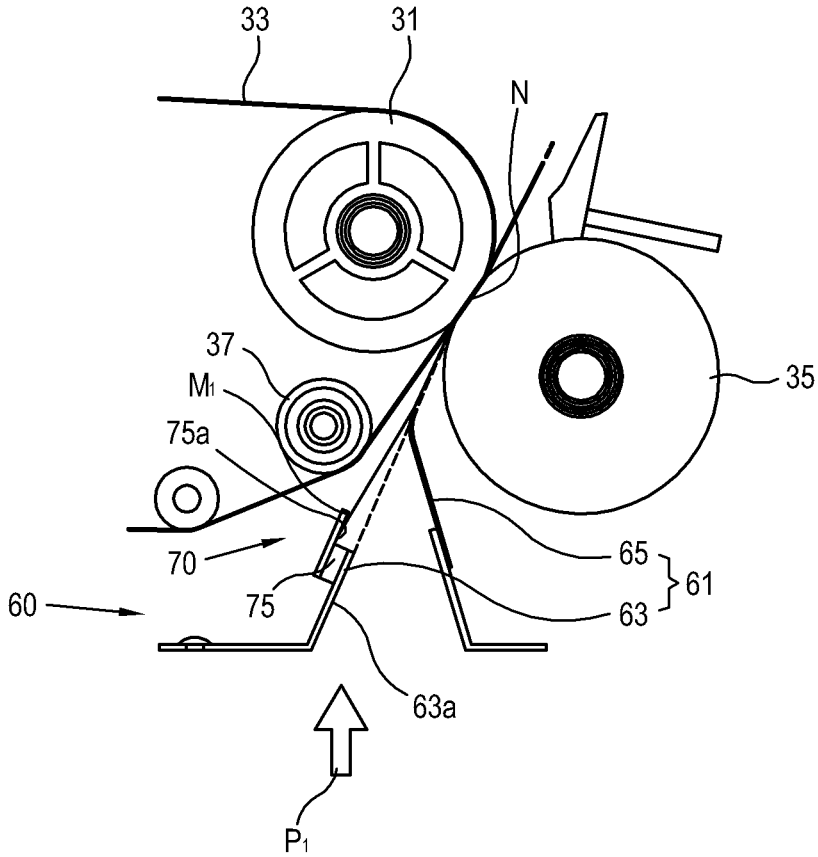
FIG. 6 is a schematic view of a structure to guide the print medium according to another embodiment of the present general inventive concept.

Referring to FIG. 6, the vibration damper 70 of the print-medium guiding structure 60 according to another embodiment of the present general inventive concept includes a regulation member 75 installed at an end part of the guide plate 63. The regulation member 75 has a regulation surface 75*a* disposed on a plane different from that of the guide surface 63*a* of the guide plate 63. Here, the regulation member 75 is simply attached to the guide plate 63, and this exemplary design requires less man-hour of manufacturing than the previous design described above where the vibration damper 70 has the bending structure.

Thus, the regulation member 75 prevents the bottom part $M_1$ of the print medium M from shaking and vibrating due to the hardness of the print medium M, since the bottom part $M_1$ is in contact with the regulation surface 75*a* of the regulation member 75 at the time when the bottom part $M_1$ of the print medium M becomes free from contact with the end part of the guide surface 63*a*.

Figure 7:
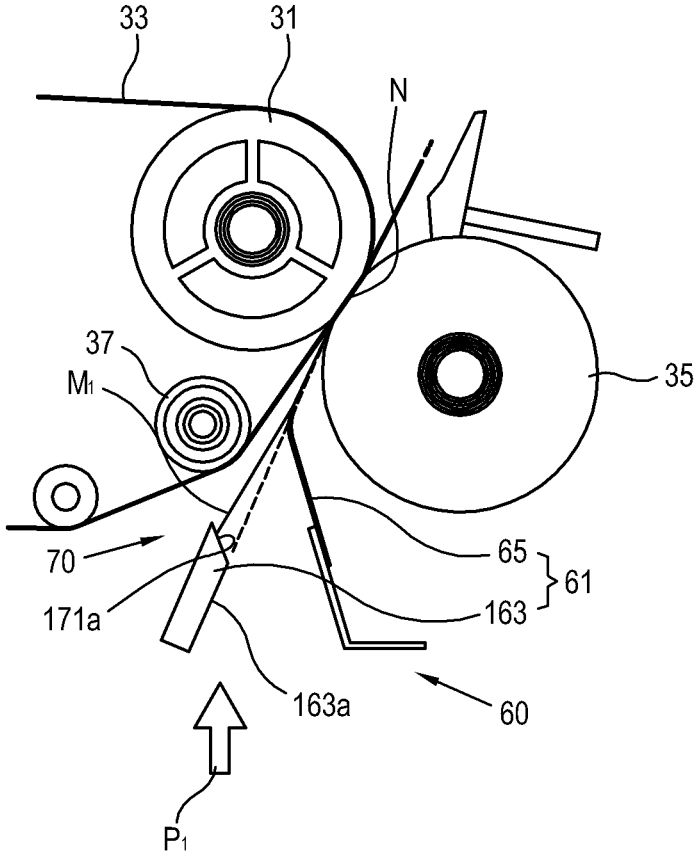
FIGS. 7 and 8 are schematic views of a structure to guide the print medium according to yet another embodiment of the present general inventive concept.
Figure 8:
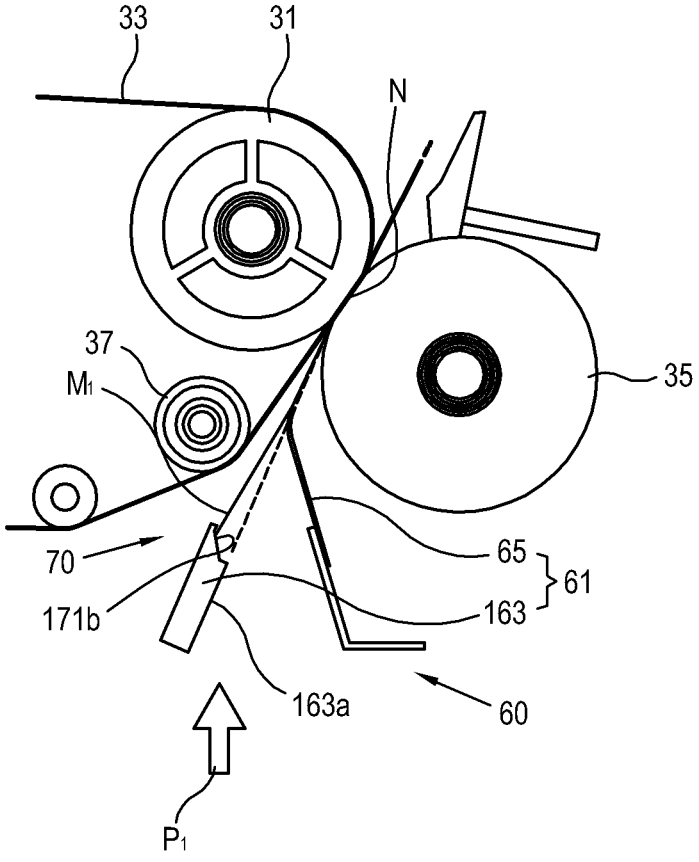

Referring to FIGS. 7 and 8, the guide unit 61 of the print-medium guiding structure 60 according to another embodiment of the present general inventive concept includes a guide block 163 having a predetermined thickness and a guide surface 163*a* with which the print medium M being supplied is in contact. The guide unit 61 also includes a guide film 65. Further, the vibration damper 70 of the print-medium guiding structure 60 according to the present embodiment includes a regulation surface 171*a* (FIG. 7) or a regulation surface 171*b* (FIG. 8) provided at an end part of the guide block 163 and forming a predetermined gradient.

As shown in FIG. 7, the regulation surface 171*a* may be provided as a flat structure at the end part of the guide block 163. As shown in FIG. 8, the vibration damper 70 may be formed at the end part of the guide block 163, and the regulation surface 171*b* may be provided as a recessed structure on an inclined surface.

Here, the regulation surfaces 171*a* and 171*b* do not affect the travel of the print medium M when the bottom part $M_1$ of the print medium M is placed on the guide surface 163*a*. On the other hand, when the print medium M becomes free from the guide surface 163*a*, the bottom part $M_1$ of the print medium M becomes in contact with the regulation surface 171*a* or 171*b*, thereby preventing the print medium M from shaking or vibrating, as would occur if the bottom part $M_1$ of the print medium M swings freely after becoming free from the guide surface 163*a* while being taken into the transfer nip or other take-in directions (take-in direction refers to the printing medium being take into a nip between two rollers, a belt and roller combination, or other type of nip which receives the printing medium therein).

Figure 9:
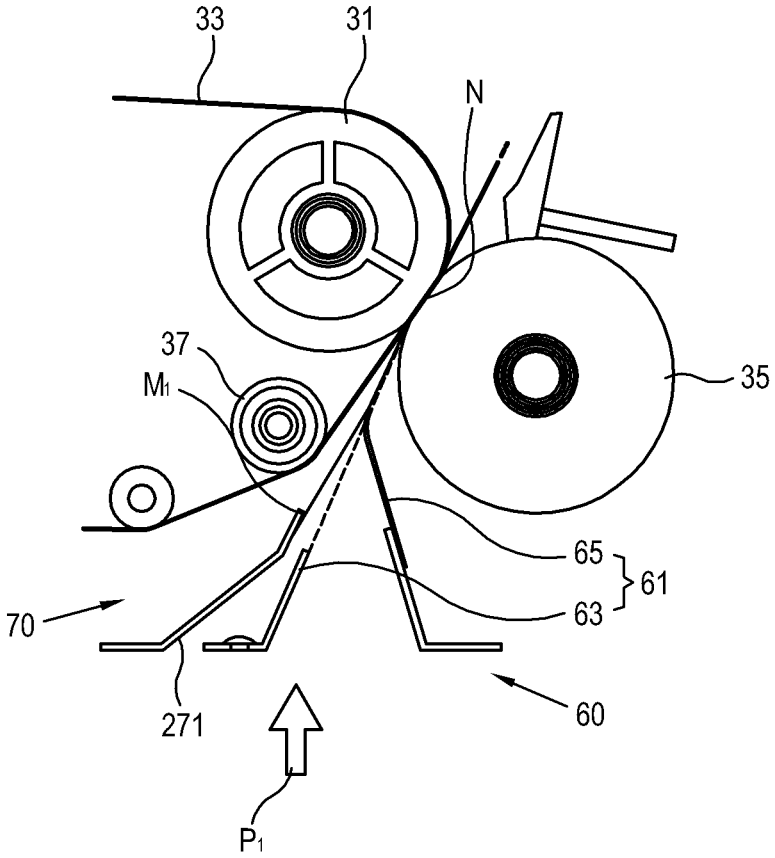
FIG. 9 is a schematic view of a structure to guide the print medium according to still another embodiment of the present general inventive concept.

Referring to FIG. 9, the vibration damper 70 of the print-medium guiding structure 60 according to yet another embodiment includes a regulation plate 271 spaced apart from the guide unit 61. The regulation plate 271 is provided at a position where it does not obstruct the travel of the print medium M in the traveling direction, and contacts the bottom part $M_1$ of the print medium M when the bottom part $M_1$ of the print medium M is free from the guide plate 63. Accordingly, the regulation plate 271 prevents the bottom part $M_1$ of the print medium M from shaking and vibrating due to the hardness of the print medium M.

Figure 10:
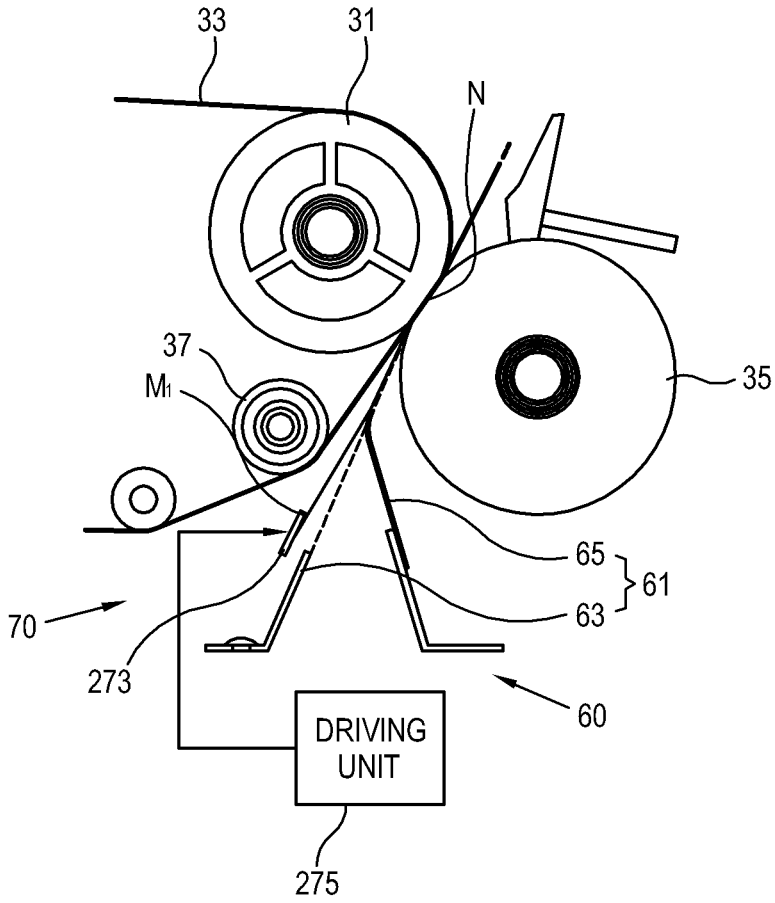
FIG. 10 is a schematic view of a structure to guide the print medium according to yet another embodiment of the present general inventive concept.

Referring to FIG. 10, the vibration damper 70 of the print-medium guiding structure 60 according to still another embodiment includes a regulation plate 273 spaced apart from the guide unit 61, and a driving unit 275.

The regulation plate 273 is provided at a position where it does not obstruct the travel of the print medium M in the traveling direction, and is further movably installed at this position. The driving unit 275 drives the regulation plate 273 to reciprocate or rotate. Thus, the driving unit 275 drives the regulation plate 273 to thereby actively regulate the shaking and vibrating degree of the bottom part $M_1$ of the print medium M.

As described above, the structure to guide the print medium additionally includes the vibration damper with a minimum change in the structure of the guide unit and the layout of components for affecting a taken-in direction of the print medium, thereby reducing a defect in the picture quality of an image to be transferred to the print medium, and particularly to the bottom part thereof.

Figure 11A:
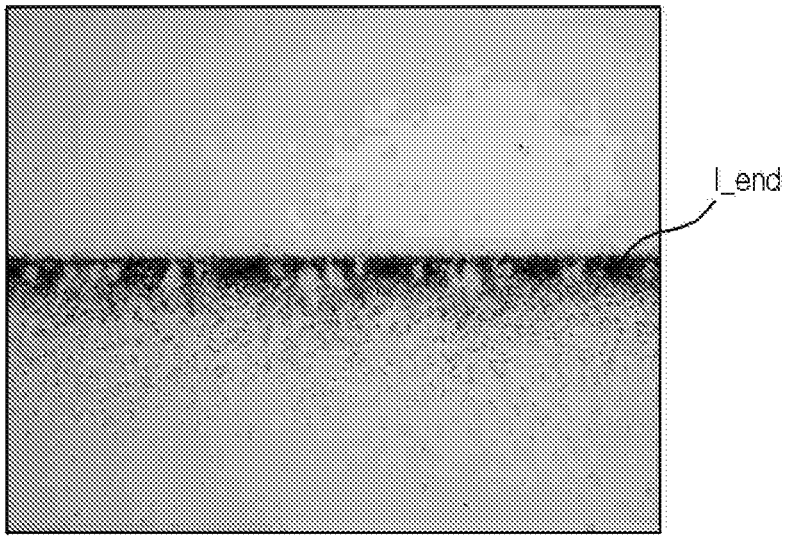
FIGS. 11A and 11B show images I_end at the bottom part of the print medium when the structure to guide the print medium is provided as shown in FIGS. 3A and 4, respectively.
Figure 11B:
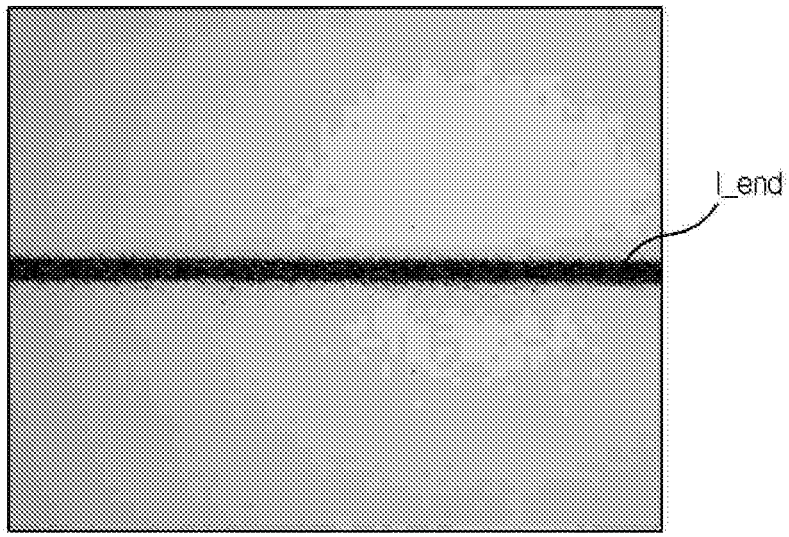

FIGS. 11A and 11B show images I_end at the bottom part of the print medium when the structure to guide the print medium is provided as shown in FIGS. 3A and 4, respectively.

In comparison between FIGS. 11A and 11B, FIG. 11A shows that the image I_end transferred to the bottom part is largely dislocated, but FIG. 11B shows that the image I_end is clearly formed with little dislocation.

Accordingly, an image forming apparatus employing the foregoing structures can make the take-in angle of the print medium be within an angle to keep the picture quality, thereby preventing a defective pattern such as a bird's foot pattern, a water-drop pattern, etc. Further, the image forming apparatus prevents the bottom part of the print medium from shaking and vibrating, so that the problem of dislocation or blur caused in an image transferred while shaking and vibrating the bottom part of the print medium can be prevented, thereby enhancing the picture quality.

In the foregoing embodiments, the print-medium guiding structure guides the take-in direction of the print medium toward the transfer position where an image is transferred to the print medium, but is not limited to such a layout.

The print-medium guiding structure may be provided to guide the take-in direction of the print medium to be taken in a carrying part that carries the print medium. In other words, an alternative embodiment of the present general inventive concept may be applied to a part where an angle of carrying the print medium is changed quickly. For example, the carrying part may include all parts such as a feeding roller 11 (refer to FIG. 1), the transfer roller 35, a fusing roller of the fusing unit 40, a take-out roller of the medium take-out unit 50, etc., which carry the print medium.

For example, when the print-medium guiding structure according to an embodiment of the present general inventive concept is installed around the feeding roller 11, the bottom part $M_1$ of the print medium M is prevented from shaking even though a carrying angle of the print medium M between the medium feeding unit 10 and the image forming unit 20 is largely changed. Thus, a defective image transfer due to the shaking of the print medium M can be prevented.

In the case that the print-medium guiding structure is provided in a print-medium carrying path around the fusing unit 40, the print-medium guiding structure prevents the bottom part $M_1$ of the print medium M from shaking even though the carrying angle is largely changed around the fusing unit 40. Accordingly, the vibration due to the shaking of the bottom part $M_1$ of the print medium M is prevented at a point of time when the bottom part $M_1$ of the print medium M passes by the part where the carrying angle is largely changed, thereby minimizing or preventing scattering of a non-fused toner and preventing a fusing defect. Also, the print medium heated at a high temperature during a fusing operation is prevented from being easily curled due to the shaking of the bottom part thereof, and thus is prevented from being jammed due to a curling of the print medium.

Further, the print-medium guiding structure may be applied to the medium take-out unit 50, so that the print medium can be prevented from a stacking defect that appears in the print medium taken-out with the shaking.

Further, the print-medium guiding structure according to an embodiment of the present general inventive concept may be applied to not only the foregoing layout but also all parts where the carrying angle of the print medium is rapidly changed.

As described above, the structure to guide the print medium may additionally include the vibration damper with a minimum change in the structure of the guide unit and the layout of components for affecting the taken-in direction of the print medium, thereby reducing a defect in the picture quality of an image to be transferred to the bottom part of the print medium. Further, the print-medium guiding structure is installed in a part where the carrying path for the print medium is rapidly changed, thereby preventing the print medium from the fusing defect, the jam defect and the staking defect which are based on the shaking of the bottom part of the print medium.

Further, the image forming apparatus employing the foregoing structure can take the print medium in the transfer nip at an angle to keep the picture quality, thereby preventing a defective pattern such as a bird's foot pattern, a water-drop pattern, etc. Also, the image forming apparatus prevents the bottom part of the print medium from shaking and vibrating, so that problems of dislocation or blur caused in an image transferred to the shaking and vibrating bottom part of the print medium can be improved, thereby enhancing the picture quality.

As described above, the present general inventive concept provides a structure to guide a print medium and an image forming apparatus employing the same, which can reduce a defect in picture quality of an image due to a shake given in a bottom part of the print medium and prevent the print medium from being jammed, with a minimum change in a layout of components for affecting a taken-in direction of the print medium.

Although a few exemplary embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus comprising:

a medium feed unit to supply a print medium;

a transfer unit including a driving roller and a transfer roller disposed opposite to the driving roller with a transfer belt interposed between the rollers so as to form a transfer nip between the transfer belt and the transfer roller, the transfer unit to transfer a toner image formed on the transfer belt to the print medium; and a first guide unit having a guide surface to receive the print medium from the medium feed unit and guide the print medium toward a second guide unit such that the print medium moves directly into the transfer nip in a take-in direction of the print medium defined by a travel path of the print medium moving from the guide surface toward the transfer nip, wherein the take-in direction of the print medium toward the transfer nip is different from a take-in direction of the transfer belt toward the transfer nip, wherein the first guide unit includes a first section to guide a travel direction of a leading edge of the print medium supplied from the medium feed unit toward the second guide unit, and a second section extending from the first section, the second section of the first guide unit adapted to enable a trailing edge of the print medium to gradually change direction, after the trailing edge is free from the first section of the first guide unit, as the print medium passes through the transfer nip, wherein the second guide unit guides the leading edge of the print medium directly toward the transfer nip after the travel direction of the leading edge of the print medium is guided by the first section of the first guide unit, wherein the take-in direction of the print medium toward the transfer nip satisfies $\theta 1<\theta 2$, where $\theta 1$ is an angle between the take-in direction of the transfer belt toward the transfer nip and the take-in direction of the print medium, and $\theta 2$ is an angle between a tangential line contacting the transfer roller at a start position of the transfer nip and the take-in direction of the print medium.

2. The image forming apparatus of claim 1, wherein the first section comprises a guide plate having an inclined guide surface and the second section comprises a regulation plate formed integrally with the guide plate.

3. The image forming apparatus of claim 2, wherein the regulation plate has a regulation surface which is bent once with respect to the guide surface of the guide plate.

4. The image forming apparatus of claim 2, wherein the regulation plate has a regulation surface which is bent twice with respect to the guide surface of the guide plate.

5. The image forming apparatus of claim 2, wherein the regulation plate is adapted to relieve the trailing edge of the print medium from shaking and vibrating when the print medium is free from the guide surface of the guide plate.

6. The image forming apparatus of claim 1, wherein the second guide unit contacts a rear side surface of the print medium opposite to a front side surface of the print medium contacted by the first guide unit.

7. The image forming apparatus of claim 1, wherein the first section comprises a guide plate having an inclined guide surface and the second section comprises a regulation plate installed at an end part of the guide plate such that a regulating surface of the regulating plate is disposed on a plane different from that of the guide surface of the guide plate.

8. The image forming apparatus of claim 1, wherein the first guide unit comprises a guide block including a guide surface defining the first section and a regulating surface defining the second section.

9. The image forming apparatus of claim 1, wherein the second section is separately provided and coupled to the first section of the first guide unit.

10. The image forming apparatus of claim 9, wherein the first section and the second section are different in material from each other.

11. The image forming apparatus of claim 1, wherein the second section comprises a regulation plate having a regulating surface that is installed such that the regulating surface is spaced apart from a guiding surface of the first section.

12. The image forming apparatus of claim 1, wherein the second guide unit comprises a guide film to maintain the travel direction of the print medium in the take-in direction of the print medium toward the transfer nip.

13. The image forming apparatus of claim 12, wherein the guide film of the second guide unit does not extend beyond a line extending from the take-in direction of the print medium.

14. The image forming apparatus of claim 1, further comprising a guide roller to adjust a gradient of the transfer belt in a vicinity of the transfer nip.

15. The image forming apparatus of claim 1, wherein the guide surface of the first guide unit receives the print medium at a contact point in common with the first and second sections.

16. A guide structure to guide a print medium from a medium feed unit toward a transfer nip which is formed between a transfer belt and a first roller disposed opposite to a second roller with the transfer belt interposed between the rollers, the guide structure comprising:

a first section having a guide surface to change a travel direction of the print medium supplied from the medium feed unit into a take-in direction of the print medium defined by a travel path of the print medium moving from the guide surface directly the transfer nip; and a second section extending from the first section, the second section adapted to enable a trailing edge of the print medium to gradually change direction, after the trailing edge thereof is free from the first section, as the print medium passes through the transfer nip, wherein the take-in direction of the print medium toward the transfer nip satisfies $\theta 1<\theta 2$, where $\theta 1$ is an angle between a take-in direction of the transfer belt toward the transfer nip and the take-in direction of the print medium toward the transfer nip, and $\theta 2$ is an angle between a tangential line contacting the first roller at a start position of the transfer nip and the take-in direction of the print medium toward the transfer nip.

17. The guide structure of claim 16, wherein the second section is formed integrally with the first section.

18. The guide structure of claim 16, wherein the second section is bent with respect to the first section.

19. The guide structure of claim 16, wherein further comprising:

a guide block including a guide surface defining the first section and a regulating surface defining the second section.

20. The guide structure of claim 16, wherein the second section comprises a regulation plate that is installed such that a regulating surface of the regulation plate is spaced apart from a guiding surface of the first section.

21. The guide structure of claim 16, wherein the guide surface of the first section receives the print medium at a contact point in common with the first and second sections.

* * * * *